United States Patent [19]

Detzel et al.

[11] 3,938,730

[45] Feb. 17, 1976

[54] FOOD CONTAINER

[75] Inventors: Josef Detzel, Weitnau; Klaus Peter Bartels, Langen, both of Germany

[73] Assignee: Lever Brothers Company, New York, N.Y.

[22] Filed: July 22, 1974

[21] Appl. No.: 490,650

[30] Foreign Application Priority Data

July 21, 1973 Germany ..... 7326904

[52] U.S. Cl. ..... 229/43; 229/14 R; 229/32; 229/51 TS; 206/525

[51] Int. Cl.[2] ..... B65D 5/64; B65D 5/54

[58] Field of Search ..... 229/43, 51 TS, 32, 14 R; 206/525

[56] References Cited

UNITED STATES PATENTS

| | | | |
|---|---|---|---|
| 1,808,530 | 6/1931 | Cooley | 229/14 R |
| 1,866,317 | 7/1932 | Miner | 229/43 |
| 3,445,050 | 5/1969 | Peters et al. | 229/43 X |
| 3,478,950 | 11/1969 | Stevens | 229/32 |
| 3,552,634 | 1/1971 | Ollier et al. | 229/43 |
| 3,580,484 | 5/1971 | Schneider | 229/51 TS |

*Primary Examiner*—Donald F. Norton
*Assistant Examiner*—Stephen P. Garbe
*Attorney, Agent, or Firm*—Arnold Grant, Esq.

[57] ABSTRACT

A food container comprising an inner heat proof tray which is closed by a lid and in which the food to be heated is contained is protected by an outer cardboard member surrounding the bottom and sides of the inner tray. Opening tabs extending from the upper edges of the cardboard member are releasably secured to the inner tray or lid so that pulling on the tabs first releases the tabs therefrom without damaging the lid or its sealing with the tray and further pulling tears the outer cardboard member so that the inner tray can be readily removed from the outer before being heated.

4 Claims, 2 Drawing Figures

FOOD CONTAINER

Figure 1:
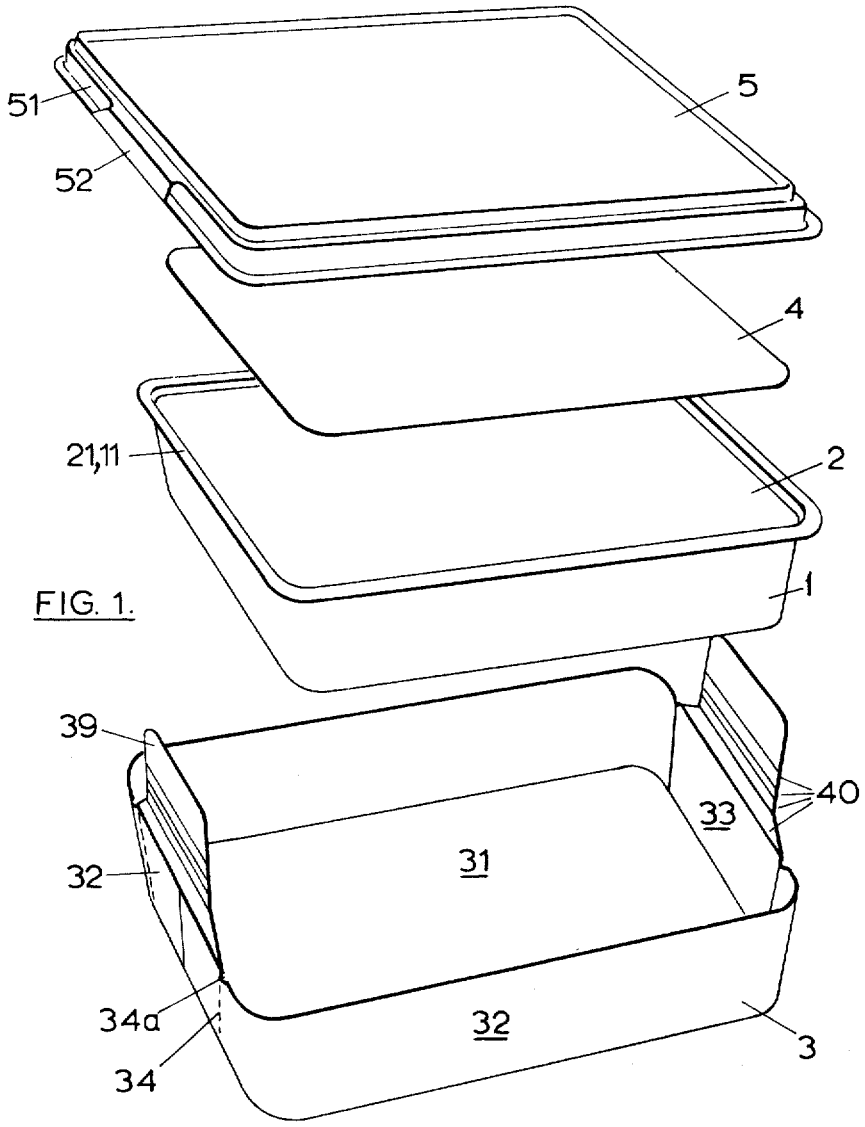

This invention relates to an improved food container and particularly to a package for ready meals. The package consists essentially of a thin heat resistant film which can be closed by a film cover or deep drawn lid and a cardboard member which surrounds the tray.

The tray, which can be deep drawn of oven proof plastic film or a thin aluminium foil, is assumed to be the container in which the ready prepared meal can be heated, eg in hot water or in an oven. In order to be able to tightly close the tray, the tray can be provided with an outwardly extending flange on which the lid can be sealed or in any other way secured. A cardboard member serves the purpose of protecting the bottom and side walls of the tray from deformation which looks particularly unsightly when the tray is formed from thin aluminium and can affect the tightness of the closing seam between the lid and the tray. The cardboard member can also be printed with information relating to the contents, the origin and other information. In that the cardboard member is not moisture proof or heat proof the tray is removed from the cardboard member before the meal is heated.

A problem with the above described package is that the cardboard member, which essentially only surrounds the tray to the underside of the flange, must be so joined to the tray that during storage and transport it is not loosened but must nevertheless be simply and easily removable by the user before the meal tray is heated.

The cardboard member comprises a bottom panel and long side walls with end wall parts connected to the ends of the long side walls. The end wall parts abut together to form the shorter end walls and they are secured to the bottom panel by glueing to connecting flaps connected to the bottom panel.

According to the present invention there is provided a food container comprising a tray provided with a sealing flange, a lid sealable to the flange to close the tray and an outer protective member of cardboard material having a bottom panel and side walls to surround the tray, opening tabs extending from the cardboard member beyond the upper edges of the side walls and folded around the flange to lie on the upper side of the lid, the opening tabs being releasably secured in position beyond the upper edges of the side walls leaving the ends free to be gripped by hand. The free ends of the opening tabs can conveniently lie loosely on the top of the lid. In this way it is possible to grip and pull the free ends of the opening tabs to break the releasable securing. The opening tabs can be releasably secured to either the upper side of the lid or to the flange or to both.

The opening tabs can conveniently form the extensions of connecting flaps folded from the bottom panel, wall parts at each end of the intermediate side walls being secured in abutting relationship on the connecting flaps to connect the side walls together and maintain the cardboard member in the erected condition.

The cardboard member can tightly surround the tray so that breaking the releasable securing of the opening tabs with the lid or flange is not sufficient to enable the tray to be removed from the cardboard member. In this case, and also when the tray is deep drawn into a pre-erected cardboard member, it is convenient that tear guides are included in the side walls of the cardboard member aligned with the edges of the connecting flaps. The tear guides can be formed by notches in the upper edges of the side walls or by substantially vertical lines of weakness in the side walls of the cardboard member or both.

After pulling the free edges of the opening tabs to break the releasable securing of the opening tabs above the upper edges of the side walls of the carton member further pulling on the ends of the tabs easily tears the side walls of the cardboard member along the lines of weakness. The side walls can then be folded away from the tray and the tray removed.

In a preferred construction the package according to the invention is provided with an additional lid, which can conveniently be of transparent deep drawn plastic film. With this lid the free ends of the opening tabs can be held in place on the top of the foil lid and it is also possible to provide a further sheet insert of carton board under the deep drawn lid, and preferably under the free ends of the opening tabs. The plastic deep drawn lid overlaps and snaps onto the edge of the foil lid and tray flange and at the same time protects them from damage. According to the invention the shaped flange of the deep drawn lid is provided in the region of the opening tabs with recesses corresponding in length to the length of the opening tabs, the snapping together of the lid and tray flanges in these regions being interrupted.

Figure 2:
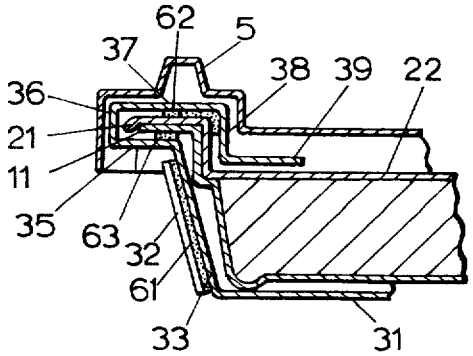

An embodiment of the invention will now be described with reference to the accompanying diagrammatic drawings in which:

FIG. 1 is an exploded perspective view of the individual components of the package; and FIG. 2 is a cross-section through the wall of the assembled package of FIG. 1 in the region of the connecting flaps.

Referring to FIG. 1 the package comprises a tray 1 which is closed by a foil lid 2. The tray is surrounded on the underside and side walls by a cardboard member 3. A sheet insert 4 of carton board can lie upon the top of the foil lid 2. A deep drawn plastic lid 5, preferably transparent, snappingly engages over the flange 11 of the tray 1 to which the edge 21 of the foil lid is sealed.

The cardboard member 3 comprises a bottom panel 31 which can be completely flat or indented in the centre region. Connected to the long edges of the bottom panel 31 are side walls 32 which are long enough so that they can be folded around the rounded corners of the tray and abut together to form end walls of the cardboard member. Connecting flaps 33 are arranged on the short edges of the bottom panel 31 to which the end wall parts of the side walls 32 are secured by glue 61 in known manner.

In accordance with the invention opening tabs are provided which form extensions of the connecting flaps 33 and extend around the flange 11 of the tray and are folded to lie on the upper side 22 of the foil lid. The opening tabs beyond the upper edges of the side walls of the cardboard member are subdivided by fold lines into separate narrow panels 35, 36, 37, 38 and 39. As shown in FIG. 2 the panels 35 lie under the flange 11, panels 36 lie against the outside periphery of the flange 11 and edge 21 of the foil lid, the panels 37 on the top of edge 21 of the foil lid, the panels 38 against the inner vertical edge of the foil lid 2 and the free ends 39 on top of the inner portion 22 of the lid 2. When the foil lid 2 is not inwardly recessed within the tray as shown in FIG. 2, but is a flat sheet, it follows that the panels 38 are not required and panels 39 form extensions of the panels 37 which cover the top of the edge 21 of the foil lid. According to the invention the panels 35 to 38 particularly panels 35 and 37 completely or only in certain areas are releasably secured to the respective parts of the flange of the tray and foil lid 2. This can conveniently be effected by using a cardboard for the cardboard member which has an inner heat sealable coating. The sealing can then be effected for example using a heat sealing tool which contacts the upper and lower parts of the flange 11 and 21 so that sealing occurs as shown at 62 and 63 in FIG. 2. The bond between the coated cardboard member and the tray and foil lid, both of which are preferably of aluminium foil, can nevertheless be easily broken without the lid being torn or otherwise damaged. The preferred sealing or glueing of the panels 35 to 38 to the flanges 11 and 21 is easily made and also provides a convenient and orderly arrangement of the opening tabs on the tray flange.

In the side walls of the cardboard are provided approximately vertical lines of weakness 35 and/or notches 34*a* in the upper edges of the side walls which facilitate removing the tray from the tightly enclosing cardboard member. These lines of weakness and notches substantially coincide with the side edges of the connecting flaps 33. By pulling on the free ends 39 of the opening tabs the bond at 62 and 63 is first broken, further pulling causing the side walls to tear along the lines of weakness 34 and separate the connecting flaps from the side walls of the cardboard member. Since the side walls of the cardboard member in the region of the rounded corners are not connected to the bottom panel 31 they are loosened from the tray 1 after tearing along the lines of weakness 34 and allow the side walls to be bent back. The tray 1 can then be removed without difficulty from the opened cardboard member.

The plastic lid 5, which can be of any desired shape, is provided with a snap rim 51 which snaps onto the flanges 11 and 21. The rim 51 is interrupted by recesses 52 in the region where the opening tabs are folded around the flange.

The package according to the invention can be varied in several different ways. It is possible, for example, to glue the free ends 39 of the opening tabs to the top of the foil lid whilst still ensuring that the ends 39 can be gripped by hand, or to fix these free ends to the carton board insert 4. Furthermore additional opening tabs can be provided in the long side walls 32 to overlap around the flanges 11 and 21 and be folded onto the foil lid in the same way as described above. Alternatively the connecting flaps can be connected to the long side walls, the opening tabs being extensions of the connecting flaps as described above.

What is claimed is:

1. A container comprising a tray having side walls with a peripheral sealing flange extending around the upper edges thereof; a lid for the tray sealingly engaging the peripheral sealing flange; and, an outer protective member closely surrounding the tray, the protective member having a bottom panel, upstanding wall panels with upper edges, connecting flaps folded up from the bottom panel to severably connect the wall panels together, and opening tabs formed by the portion of the connecting flaps extending beyond the upper edges of the wall panels, the opening tabs being folded around the peripheral sealing flange of the tray to lie on the lid, the opening tabs having securing portions releasably secured in position with the lid and end portions which are not secured to the lid whereby pulling on the end portions of the opening tabs will break the connection of the securing portion of the opening tabs with the lid and the connection of the connecting flaps and side wall panels and allow the protective member to fold flat.

2. A container according to claim 1 in which the severable connection of the connecting flaps to the wall panels of the protective member is formed by tear guides in the wall panels of the protective member aligned with the connecting flaps.

3. A container according to claim 1 in which the opening tabs are releasably secured to the peripheral sealing flange of the tray.

4. A container according to claim 1 having an additional lid with a peripheral rim snappingly engaged with the peripheral sealing flange of the tray, the additional lid having recesses in the rim coinciding with the opening tabs, the recesses interrupting the rim at those regions.

* * * * *